US008522511B2

(12) United States Patent
Thoren et al.

(10) Patent No.: US 8,522,511 B2
(45) Date of Patent: Sep. 3, 2013

(54) METHODS AND APPARATUS FOR MAST SYSTEM WITH ENHANCED LOAD BEARING

(75) Inventors: Matthew D. Thoren, Tyngsboro, MA (US); Joseph C. DiMare, Somerville, MA (US); Cameron B. Goddard, Lexington, MA (US)

(73) Assignee: Raytheon Company, Waltham, MA (US)

( * ) Notice: Subject to any disclaimer, the term of this patent is extended or adjusted under 35 U.S.C. 154(b) by 150 days.

(21) Appl. No.: 12/973,246

(22) Filed: Dec. 20, 2010

(65) Prior Publication Data

US 2012/0151853 A1 Jun. 21, 2012

(51) Int. Cl.
*E04C 3/00* (2006.01)

(52) U.S. Cl.
USPC ..... 52/844; 52/118; 52/121; 52/651.07; 52/745.18

(58) Field of Classification Search
USPC ..... 52/117, 118, 121, 632, 651.01, 651.02, 52/651.07, 589.1, 590.2, 844, 745.18; 343/878, 343/883
See application file for complete search history.

(56) References Cited

U.S. PATENT DOCUMENTS

| | | | | | |
|---|---|---|---|---|---|
| 160,290 | A * | 3/1875 | Trenchard | 248/404 |
| 2,222,527 | A * | 11/1940 | Boughter | 403/52 |
| 2,675,211 | A * | 4/1954 | Gerard | 254/387 |
| 3,013,584 | A * | 12/1961 | Reed et al. | 138/145 |
| 3,147,829 | A * | 9/1964 | Johnson et al. | 52/115 |
| 3,248,831 | A * | 5/1966 | Jones | 52/121 |
| 3,495,370 | A * | 2/1970 | Habrom et al. | 52/632 |
| 4,357,785 | A * | 11/1982 | Eklund | 52/632 |
| 4,657,112 | A * | 4/1987 | Ream et al. | 182/69.4 |
| 4,866,893 | A | 9/1989 | McGinnis | |
| 5,052,645 | A * | 10/1991 | Hixon | 248/125.2 |
| 5,101,215 | A | 3/1992 | Creaser, Jr. | |
| 5,175,971 | A * | 1/1993 | McCombs | 52/843 |
| 5,228,251 | A * | 7/1993 | Frigon | 52/111 |
| 5,537,125 | A | 7/1996 | Harrell, Jr. et al. | |
| D392,397 | S * | 3/1998 | Werber | D25/126 |
| 7,470,093 | B2 * | 12/2008 | Mansfield | 405/284 |
| 7,654,923 | B2 | 2/2010 | Bianchi et al. | |
| 8,011,308 | B2 * | 9/2011 | Picchio | 108/147 |
| 2002/0050112 | A1 * | 5/2002 | Koch et al. | 52/651.07 |

* cited by examiner

*Primary Examiner* — Brian Glessner
*Assistant Examiner* — Adriana Figueroa
(74) *Attorney, Agent, or Firm* — Daly, Crowley, Mofford & Durkee, LLP

(57) ABSTRACT

Methods and apparatus for providing a mast system including a telescoping mast having first and second mast sections, the mast having a stowed configuration and a deployed configuration, the first mast section including an inner surface having ribs disposed thereon, and, the second mast section including a coupling mechanism to engage the ribs on the first mast section for enabling axial movement of the second mast section with respect to the first mast section.

12 Claims, 20 Drawing Sheets

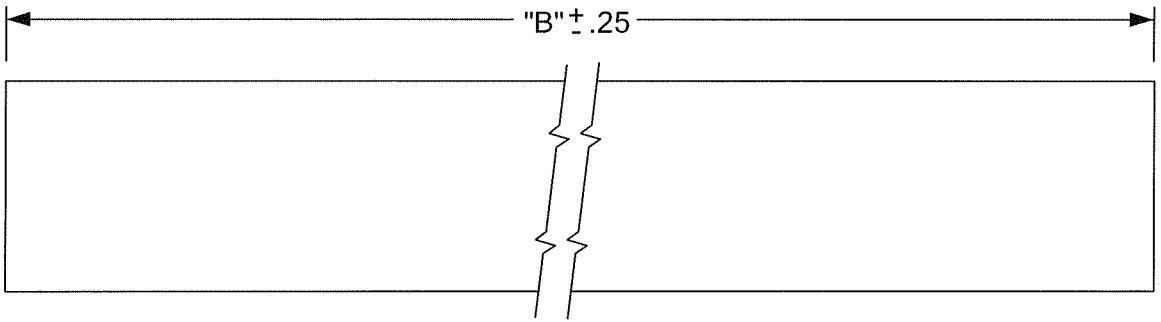
FIG. 5C
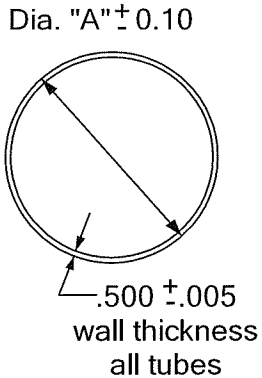
FIG. 5B
36" Base - Tube
| Dimension | |
|---|---|
| A | B |
| 36.00 | 228.00 |
| 34.00 | 216.00 |
| 32.00 | 216.00 |
| 30.00 | 216.00 |
| 28.00 | 216.00 |
FIG. 5D
24" Base - Tube
| Dimension | |
|---|---|
| A | B |
| 24.00 | 228.00 |
| 22.00 | 216.00 |
| 18.00 | 216.00 |
| 16.00 | 216.00 |
| 14.00 | 216.00 |
FIG. 5E

METHODS AND APPARATUS FOR MAST SYSTEM WITH ENHANCED LOAD BEARING

STATEMENT REGARDING FEDERALLY SPONSORED RESEARCH

The present invention was made with government support under Contract No. W31P4Q-09-G-0001 awarded by the U.S. Army Lower Tier Program Office (LTPO) in Huntsville, Ala. The government has certain rights in the invention.

BACKGROUND

As is known in the art, mast systems are used to elevate and support a payload. For example, telescoping antennas are widely used for portable communication, radar systems, surveillance systems, etc. In telescoping antennas, a series of mast sections are coaxially aligned to enable capture of each mast section into the next larger section. Telescoping antennas provide a compact stowed configuration, which is also known as a nested length, and an extended deployed configuration. As is well known in the art, the stowed configuration facilitates transport of the telescoping antenna to a desired location at which the antenna can be positioned for transition to the deployed configuration.

There are a variety of known mechanisms and structures to manipulate the antenna from the stowed configuration to the deployed configuration in which the antenna mast is fully extended, typically in the vertical direction. Known mechanisms include cables, screw drives, pulley drives, breach loadings, motor actuators, and the like. These mechanisms are generally complex with poor performance in adverse conditions.

Telescoping antennas can be located in harsh environmental conditions that can degrade performance. Windy arid locations, such as deserts, can result in sand and other debris damaging the tightly fitted telescoping mast sections. Known mechanisms to combat sand include wipers, sleeves, and the like. However, these mechanisms require continual maintenance and replacement to ensure proper functionality over the life of the mast system.

SUMMARY

The present invention provides methods and apparatus for a telescoping antenna having structural members, such as ribs, on mast sections to increase load bearing. With this arrangement, an elegant telescoping mechanism is provided for applications requiring an antenna mast. While exemplary embodiments of the invention are shown and described in conjunction with particular communication applications and antenna configurations, it is understood that the invention is applicable to telescoping antennas in general in which it is desirable to bear loads.

In one aspect of the invention, a mast system comprises: a telescoping mast having first and second mast sections, the mast having a stowed configuration and a deployed configuration, the first mast section including an inner surface having ribs disposed thereon, and the second mast section including a coupling mechanism to engage the ribs on the first mast section for enabling axial movement of the second mast section with respect to the first mast section.

The mast system can further include one or more of the following features: the coupling mechanism includes channels to capture the ribs, the coupling mechanism includes bushings to capture the ribs, the ribs include a bulbous portion extending from a stein extending from an inner surface of the first mast section, a liner disposed in the second mast section, the first and second mast sections have outer surfaces configured to provide a gap, the gap is sized to allow debris to pass through the first and second mast sections, a liner in the second mast section to maintain alignment of the first and section mast sections, the second mast section includes an engagement mechanism to engage a guy wire to stabilize the mast in a deployed configuration and to manipulate the second mast section to the deployed configuration, the engagement mechanism forms part of an end cap extending about an inner surface of an end of the second mast section, the end cap includes apertures for the ribs, and/or the liner has an undulating inner surface.

In another aspect of the invention, a method comprises: forming a telescoping mast having first and second mast sections, the mast having a stowed configuration and a deployed configuration, employing ribs on an inner surface of the first mast section to engage a coupling mechanism on the second mast section, and configuring the ribs and the coupling mechanism to enable axial movement of the second mast section with respect to the first mast section.

The method can further include one or more of the following features: configuring outer surfaces of the first and second mast sections to form a gap for enabling debris to pass through the gap between the first and second mast sections, securing a liner in the second mast section to maintain alignment of the first and section mast sections, and/or employing an engagement mechanism to engage a guy wire to stabilize the mast in a deployed configuration and to manipulate the second mast section to the deployed configuration.

BRIEF DESCRIPTION OF THE DRAWINGS

The foregoing features of this invention, as well as the invention itself, may be more fully understood from the following description of the drawings in which:

FIGS. 5B, 5C, 5D and 5E show exemplary dimensions for a mast section for the mast system of FIG. 5;

DETAILED DESCRIPTION

Figure 1:
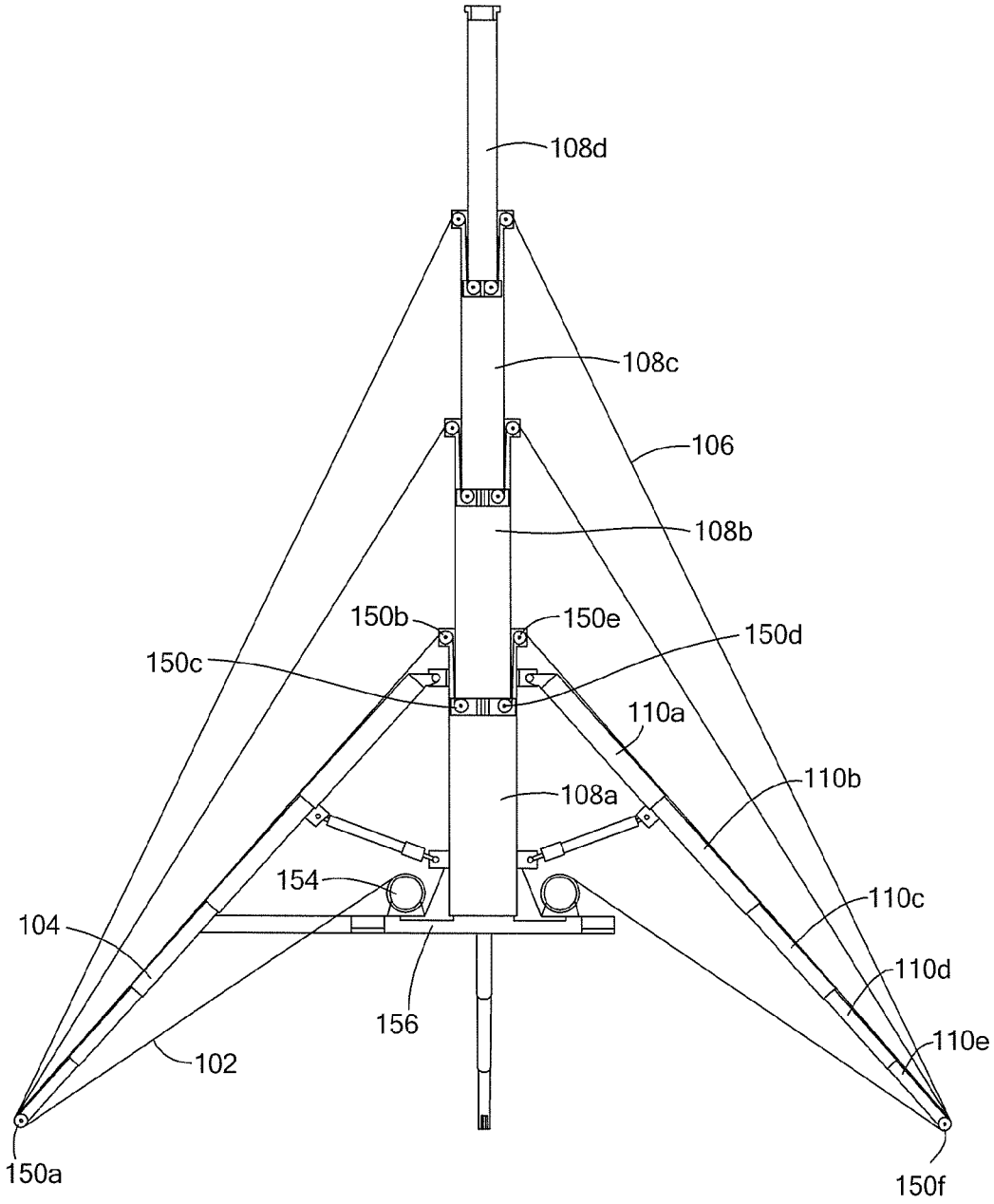
FIG. 1 is a schematic representation of a telescoping mast system in accordance with exemplary embodiments of the invention.

FIG. 1 is an exemplary telescoping mast system 100 including a guy wire telescoping mechanism 102 having a stabilization structure 104 with a guy wire 106 to support the mast 108 and also to manipulate at least one mast section between stowed and deployed configurations. The guy wire 106 forms a portion of the stabilization structure 104 to support the mast and also telescope the mast 108 so as to provide significant advantages over known systems, such as reduced mast deployment time, reduced manpower for deployment, and reduced complexity and parts count.

As is known in the art, a guy wire or guy-rope is a tensioned cable extending from a mast, or other elongate structure, to the stabilization structure, ground, or other anchor point to provide stability. Typically, a number of guy wires are used about a radius from the mast base. Radio towers, for example, typically have a series of guy wires attached at multiple heights to stabilize the tower for preventing tip over.

The stabilization structure 104 stabilizes the mast 108 in the deployed configuration. In the illustrated embodiment, the stabilization structure 104 includes a number of outriggers 110 that extend radially from the mast 108 at an angle in the deployed configuration. In the stowed configuration, the outriggers 110 can be generally parallel to the mast or other position to facilitate storage and transport.

In one embodiment, a pulley system 150 manipulates the guy wire 106, which extends from a winch mechanism 154 to an anchor point 156 via the outriggers 110 and antenna mast sections 108, as described more fully below.

A first mast section 108*a*, a second mast section 108*b*, a third mast section 108*c*, a fourth mast section 108*d*, and a fifth mast section 108*e*, are coaxially aligned to enable capture of the second mast section into the first mast section, the third mast section into the second mast section, and so on. The first mast section 108*a* has a diameter that is slightly larger than a diameter of the second mast section 108*b*, which has a diameter slightly larger than the third mast section 108*c*, and so on. The mast sections 108 are moved to the deployed configuration by the winch mechanism 154 pulling the guy wire 106.

As the guy wire 106 is pulled, the second mast section 108*b* is pulled out from the base or first mast section 108*b*. Similarly, the guy wire 106 pulls the third mast section 108*c* out of the second mast section 108*b*, etc. When the mast sections 108 are deployed as desired, as shown for example, in FIG. 2B, the guy wire 106 can be locked down to maintain tension in the guy to support the extended mast.

In an exemplary embodiment, the outriggers are moved manually or automated to a deployed configuration to support the extended mast. Once extended, the winch mechanism 154 can retract the guy wire to deploy/telescope the mast.

It is understood that the guy wire can be coupled to the mast section(s) in a variety of configurations that are effective to cause axial movement of the mast section as the guy wire is pulled/retracted. In general, the guy wire can move axially with respect to a mast section to create axial movement of the mast section. The position of the guy wire in relation to the mast section should be maintained while the guy wire moves.

Figure 2:
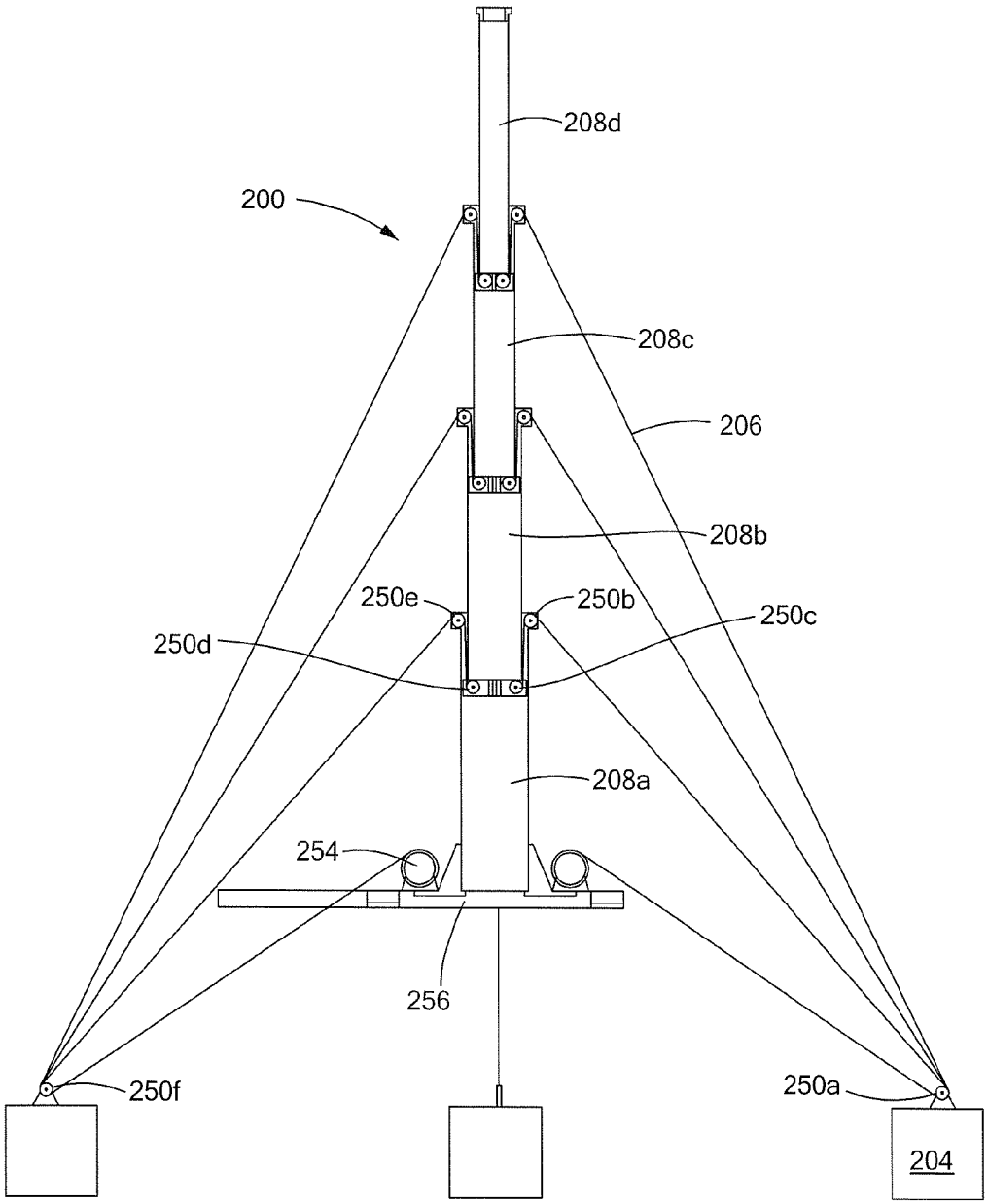
FIG. 2 is a schematic representation of a further telescoping mast system in accordance with exemplary embodiments of the invention.

It is understood that a variety of stabilization structures that include a guy wire to telescope a mast section can be provided in alternative embodiments. FIG. 2 shows an exemplary embodiment having a plurality of mast sections 208 manipulated by a guy wire 206 coupled to a pulley system 250 secured to a stabilization structure 204. A winch mechanism 254 applies a force to the guy wire 206. An anchor point 256 supports the vertical mast sections 208 and the winch mechanism 254.

Figure 2A:
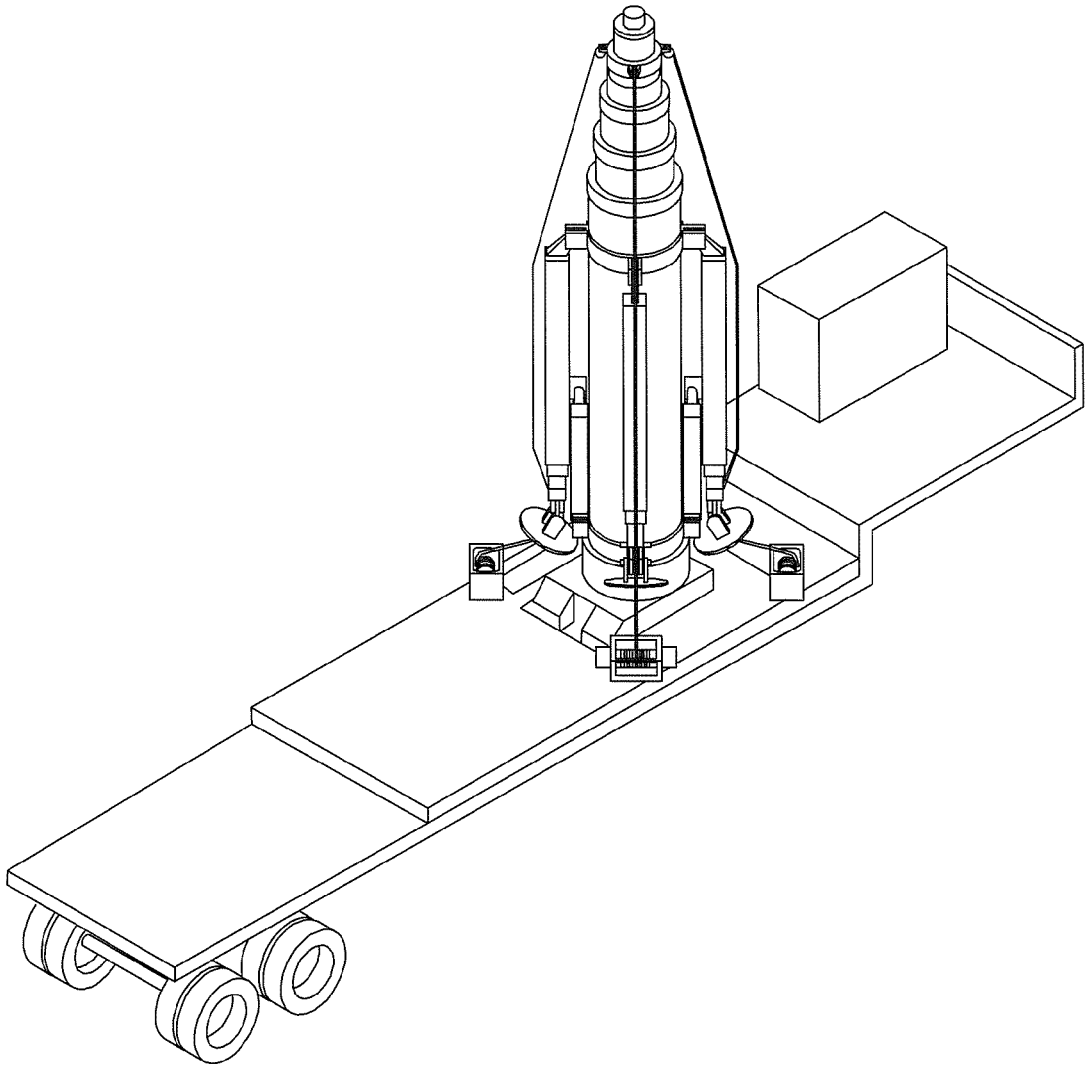
FIG. 2A is a pictorial representation of a mobile mast system in accordance with exemplary embodiments of the invention.
Figure 2B:
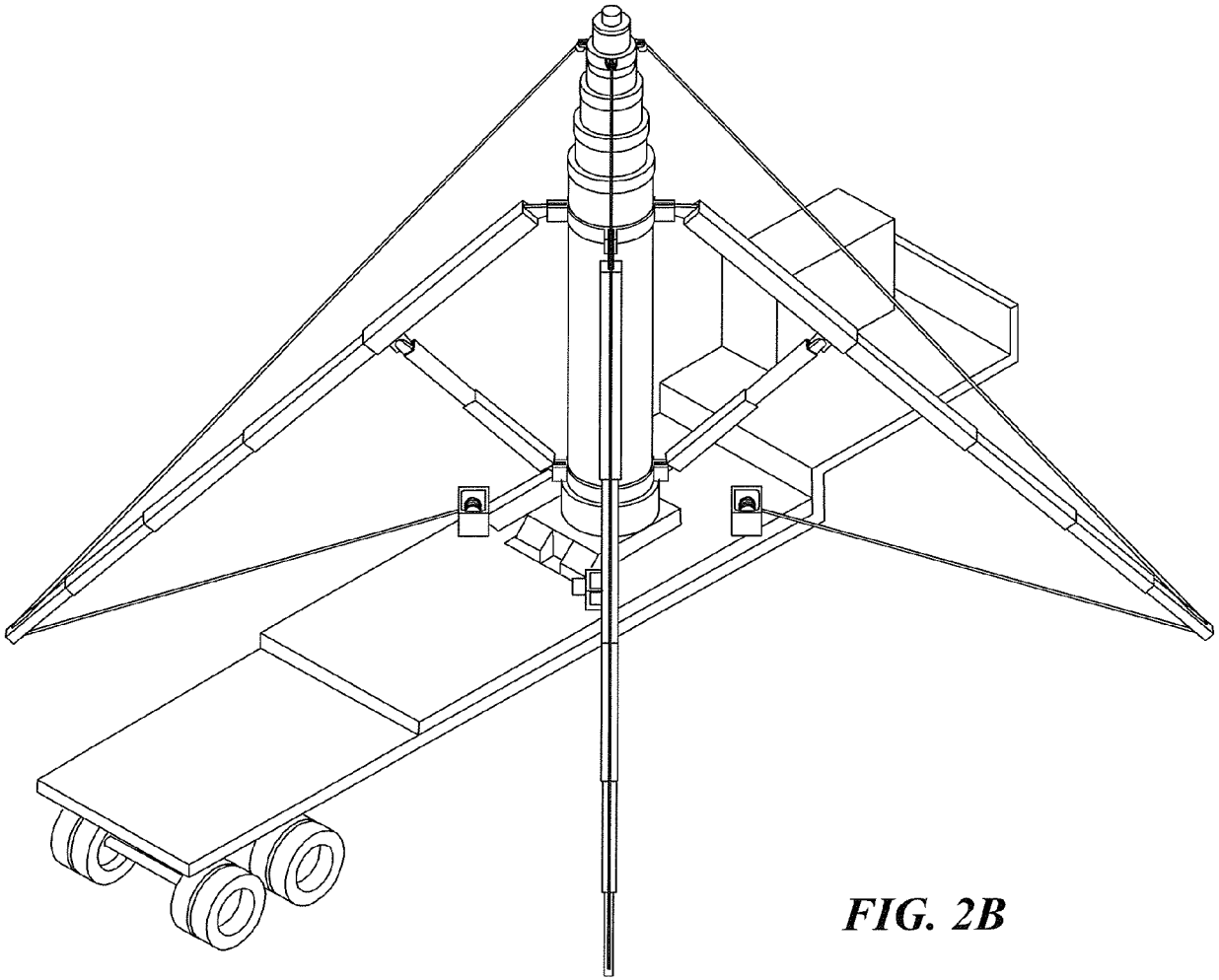
FIG. 2B is a pictorial representation of the mast system of FIG. 2A shown partially deployed.
Figure 2C:
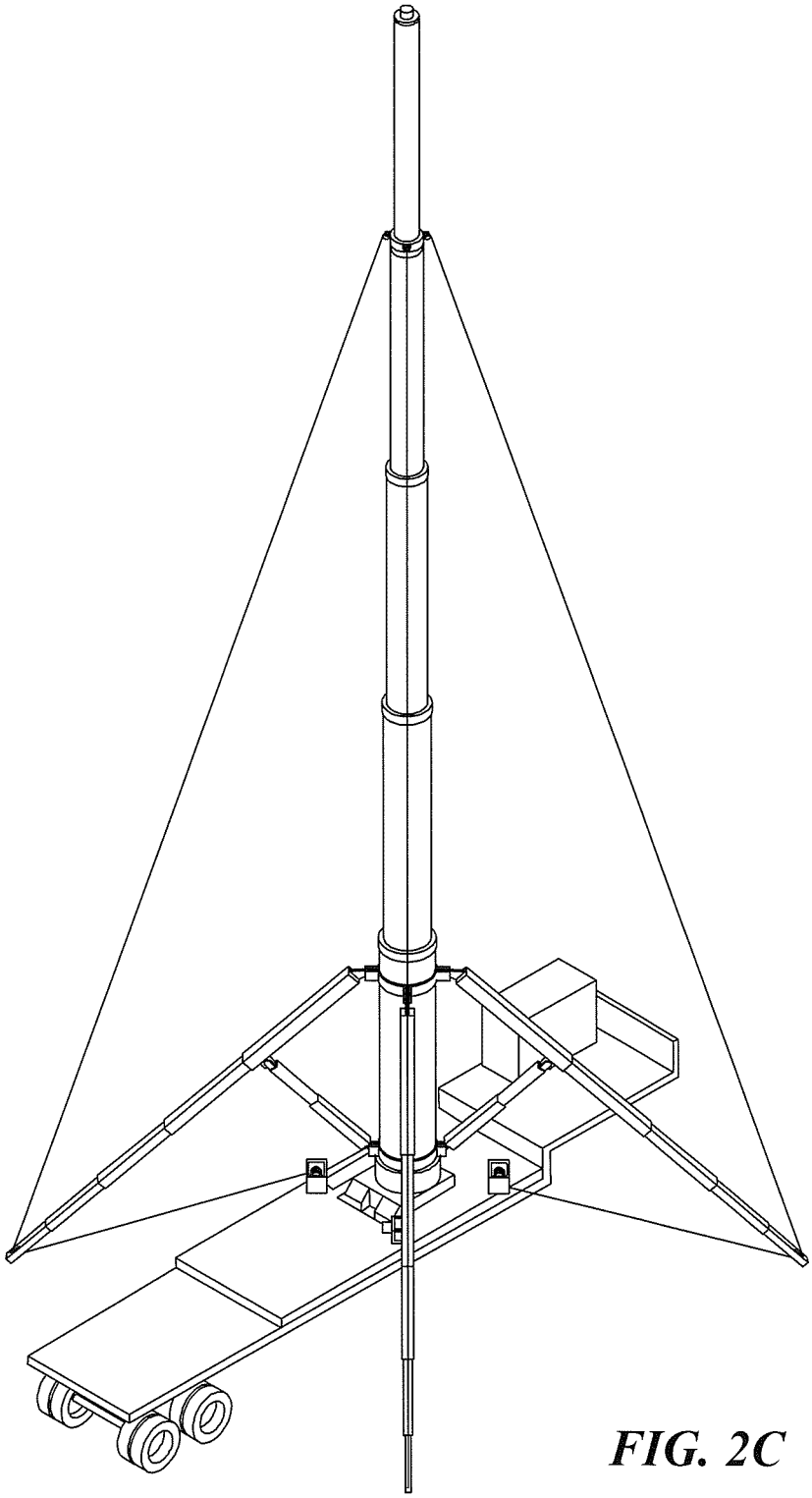
FIG. 2C is a pictorial representation of the mast system of FIG. 2A in a deployed configuration.

An exemplary stowed configuration is shown in FIG. 2A and an exemplary deployed configuration is shown in FIG. 2C. FIG. 2B shows the mast system partially deployed with the outriggers extended prior to raising the mast. The telescoping mast can be transported on a flatbed or other vehicle for mobile installation.

Figure 3:
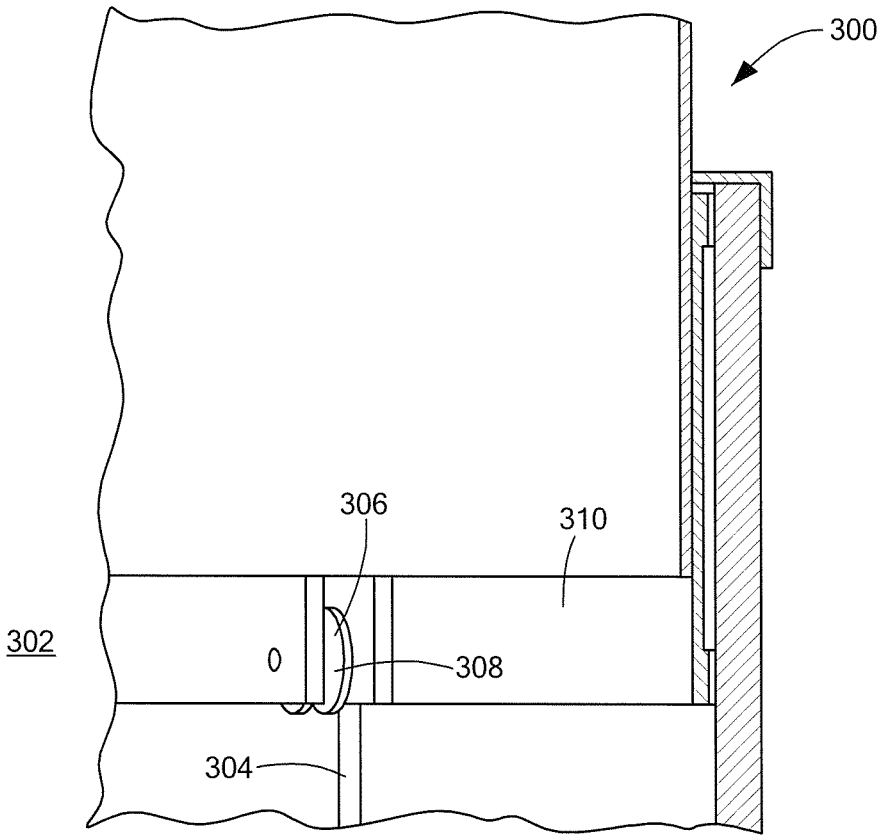
FIG. 3 is a schematic representation of a mast section interface in accordance with exemplary embodiments of the invention.

FIG. 3 shows part of an exemplary mast section 300 having an engagement mechanism 302 to engage the guy wire 304. A single pulley is shown to facilitate an understanding of the invention. In general, axial movement of the guy wire 304 in a first direction pulls the mast section 300 out of a larger mast section to deploy the mast. Movement of the guy wire 304 in the opposite direction allows the mast section 300 to be captured by the larger mast section in a transition to the stowed configuration.

It is understood that a variety of suitable mechanisms can be used to engage the guy wire and the mast section(s) to enable telescoping of the mast section(s). Exemplary motorized, hydraulic, pneumatic, manual winches and handcranks are well known to one of ordinary skill in the art. Suitable winches are available from Ingersoll Rand Corporation and other companies, hand cranks are available from the David Round Company of Streetsboro, Ohio. Come-a-longs are available from Gempler's of Madison, Wis.

It is understood that any practical number of mast sections and outriggers can be used to meet the needs of a particular application. It is further understood that the length of the mast sections, the amount of mast section overlap in the deployed configuration, the pulley tension level, outrigger length and angle, can vary based upon desired parameters.

FIGS. 4A-F show an exemplary telescoping mast 400 system having a plurality of mast sections 402*a-e* each of which is manipulated by a separate guy wire 404*a-d*. The second mast section 402*b* is moved axially out of the first mast section 402*a* by a first guy wire 404*a* via a first engagement mechanism 406*a* that enables movement of the guy wire to pull up the mast section. The third mast section 402*c* is moved axially out of the second mast section 402*b* by a second guy wire 404*b*. Similarly, the fourth mast section 402*d* and fifth mast section 402*e* are independently manipulated by respective third and fourth guy wires 404*c, d*. As shown in the illustrated embodiment, additional guy wires can be secured to the mast sections as desired.

It is understood that any practical number of guy wires can be used to meet the needs of a particular application. For example, a single guy wire can manipulate each mast section, with the guy wires extending from a different position for each mast section. For example, looking downward at an extended mast, a first guy wire extends at zero degrees, a second guy wire at 90 degrees, a third guy wire at 180 degrees, and a fourth guy wire at 270 degrees.

Figure 4A:
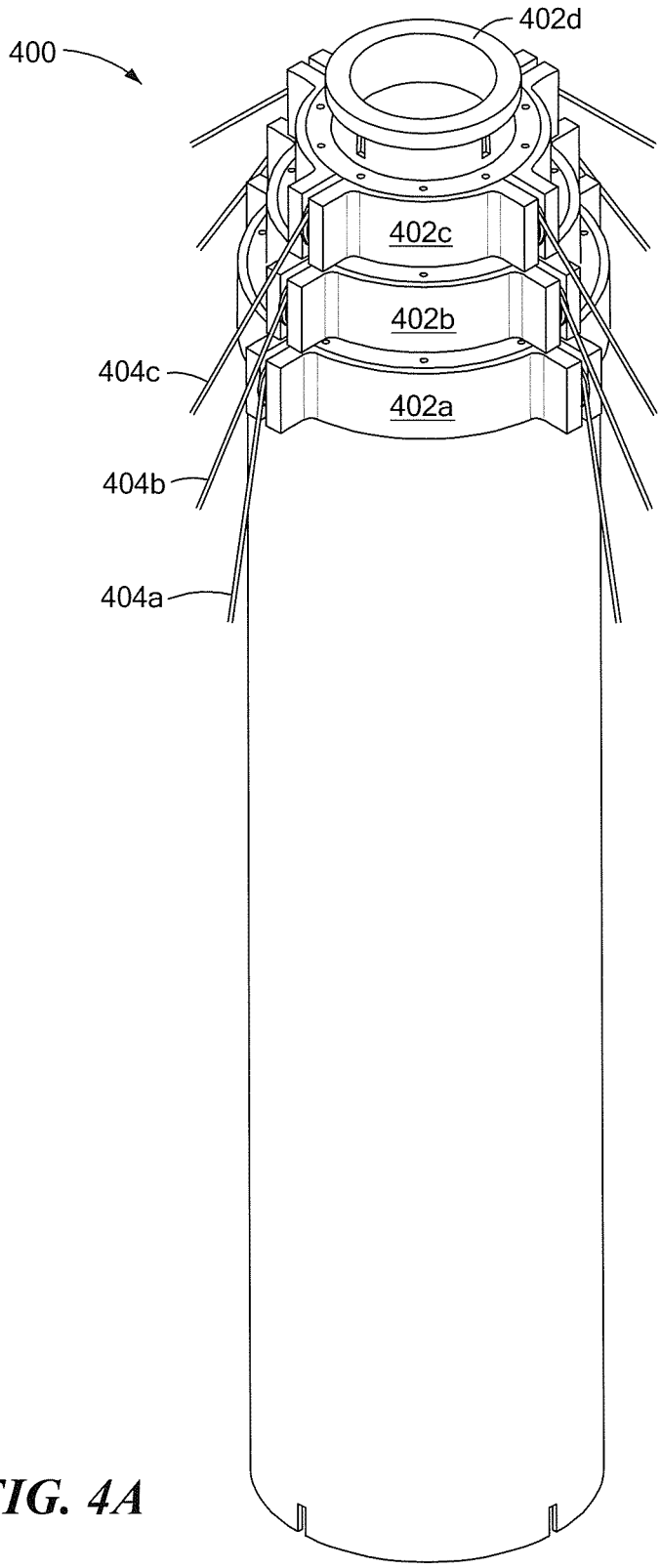
FIG. 4A is a isometric view of a telescoping mast system in accordance with exemplary embodiments of the invention.
Figure 4B:
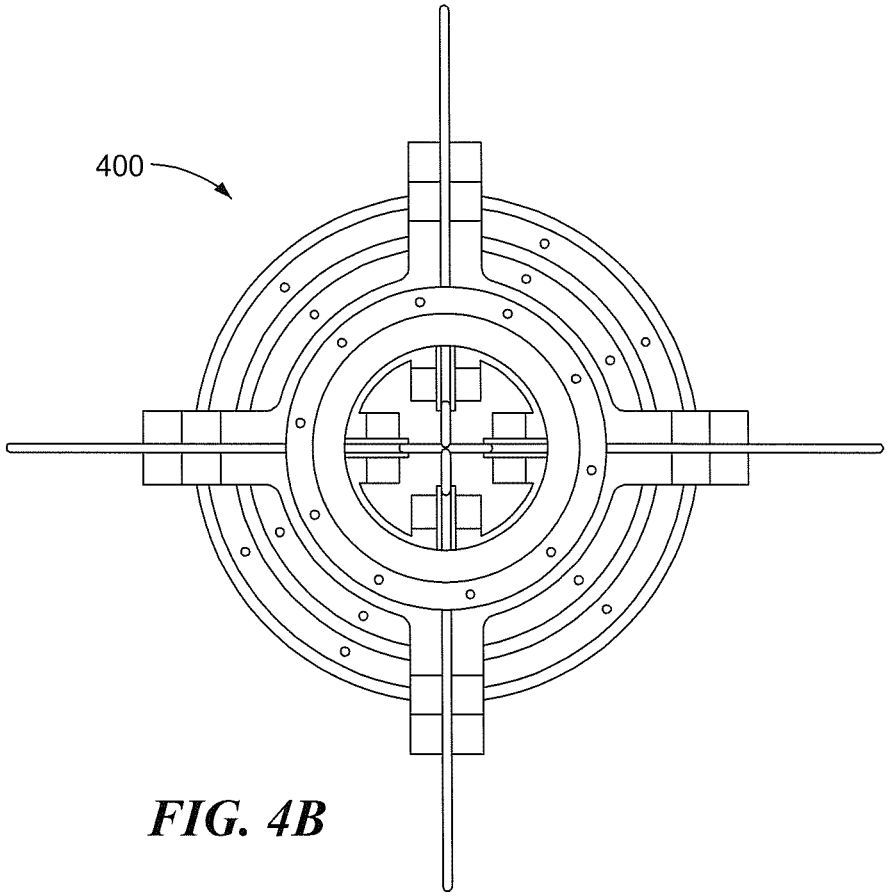
FIG. 4B is a top view of the mast system of FIG. 4A.
Figure 4C:
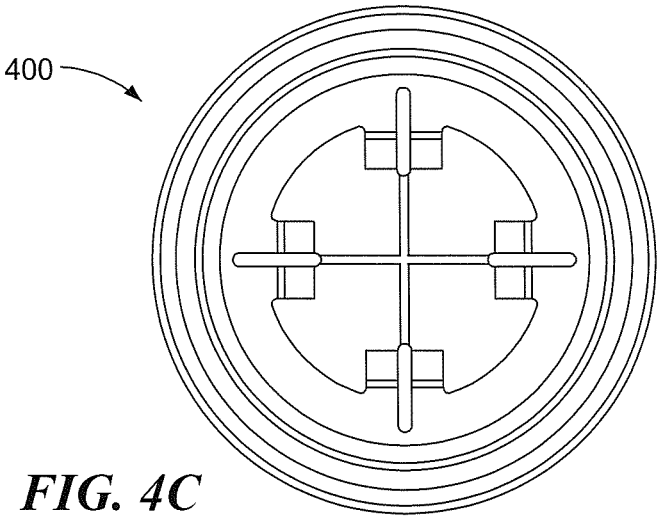
FIG. 4C is a cross-sectional top view of the mast system of FIG. 4A.
Figure 4D:
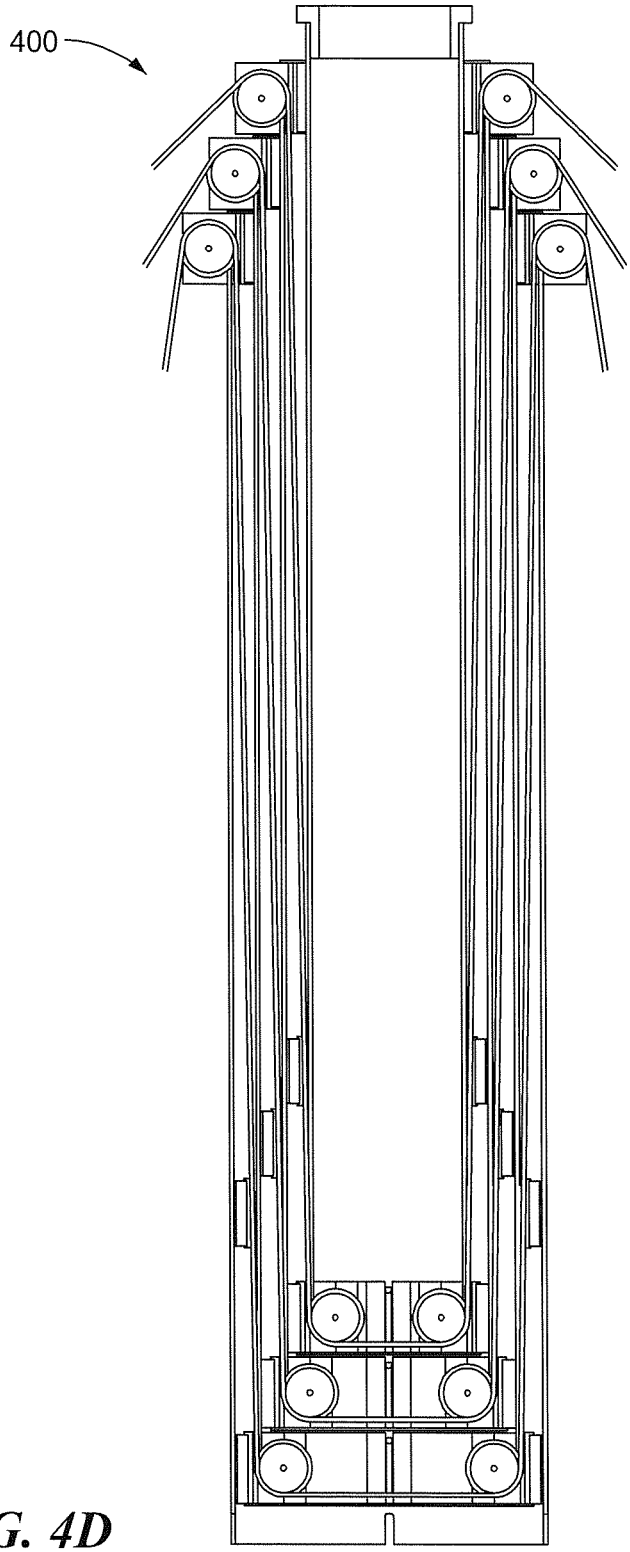
FIG. 4D is a cross-sectional side view of the mast system of FIG.
Figure 4E:
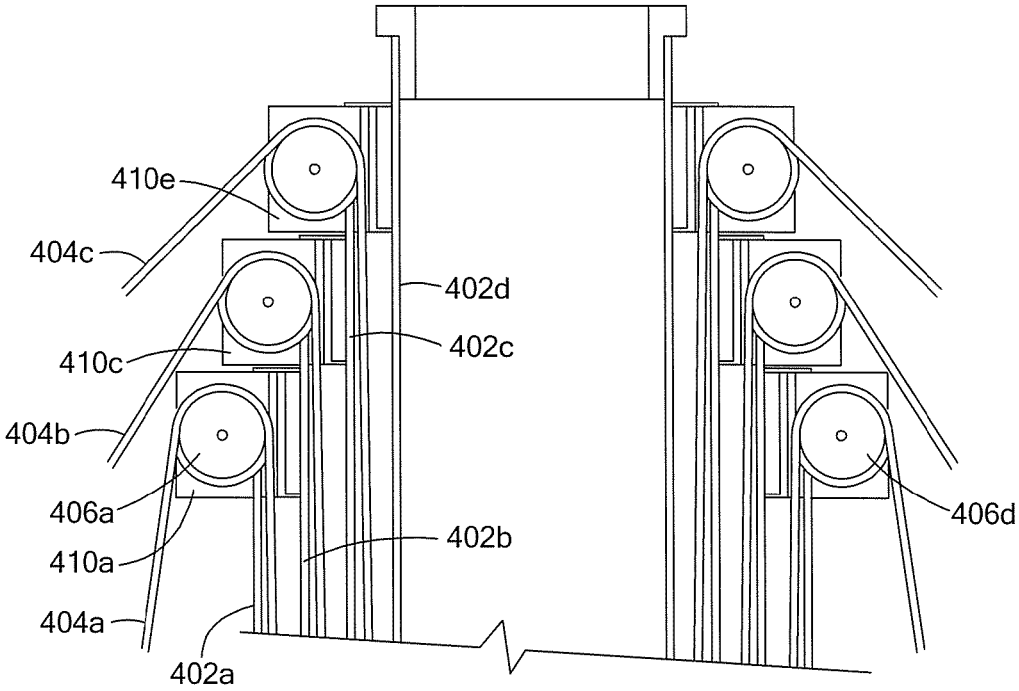
FIG. 4E is a cross-sectional view showing further detail for a top portion of the mast system of FIG. 4D.
Figure 4F:
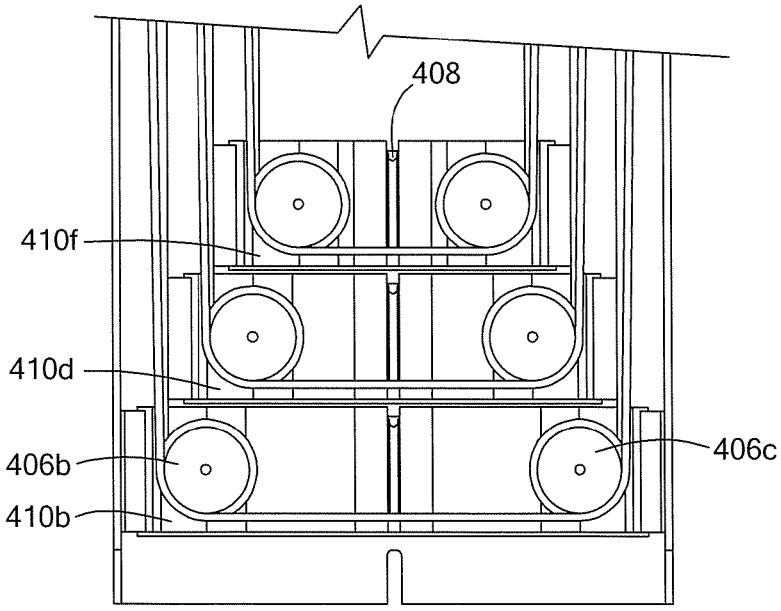
FIG. 4F is a cross-sectional view showing further detail for a bottom portion of the mast system of FIG. 4D.
Figure 4G:
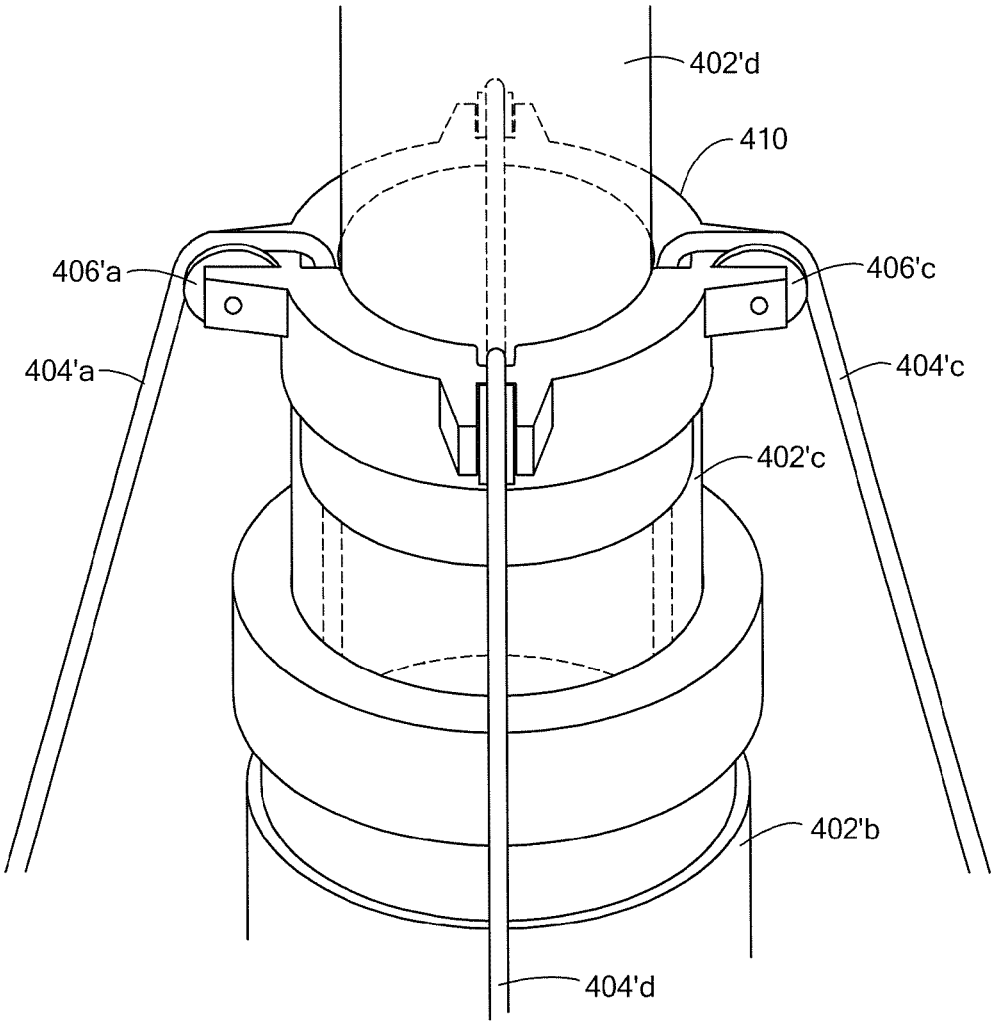
FIG. 4G shows a schematic representation of a portion of an alternative embodiment of a mast system in accordance with exemplary embodiments of the invention.
Figure 4H:
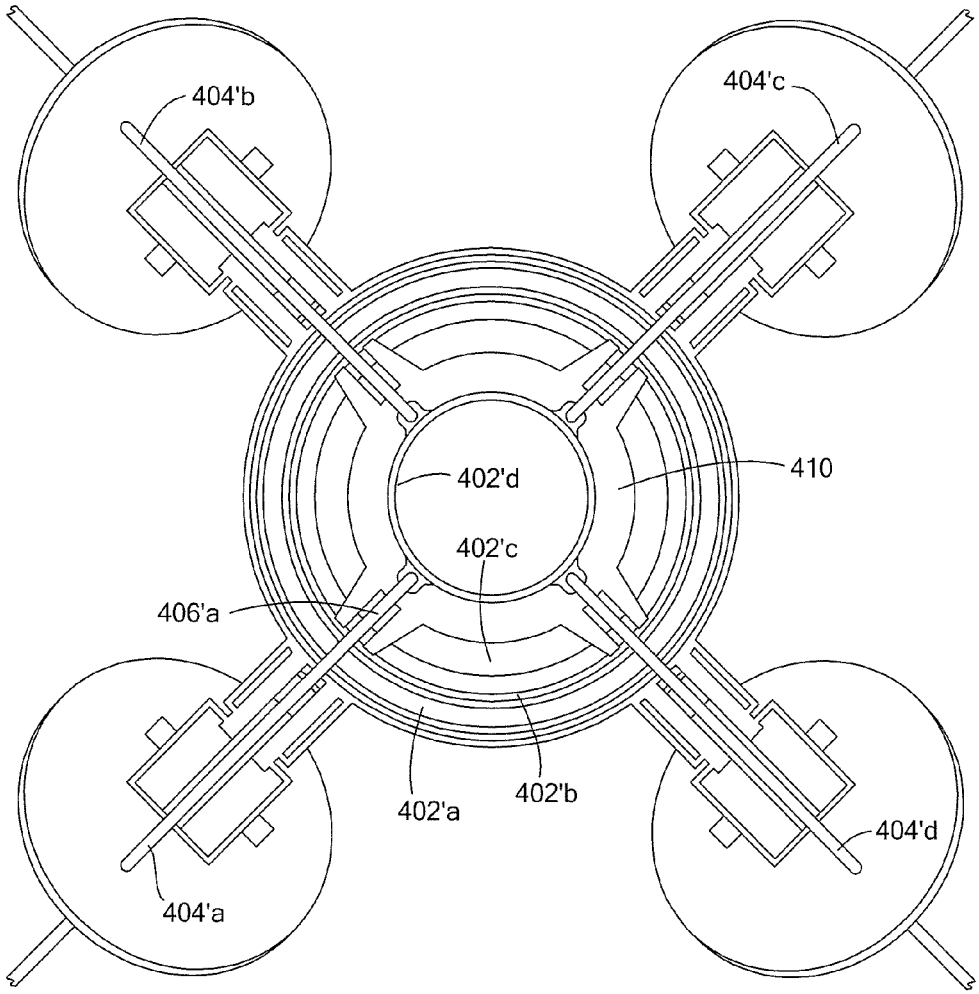
FIG. 4H is a top view of the mast system of FIG. 4G.
Figure 5:
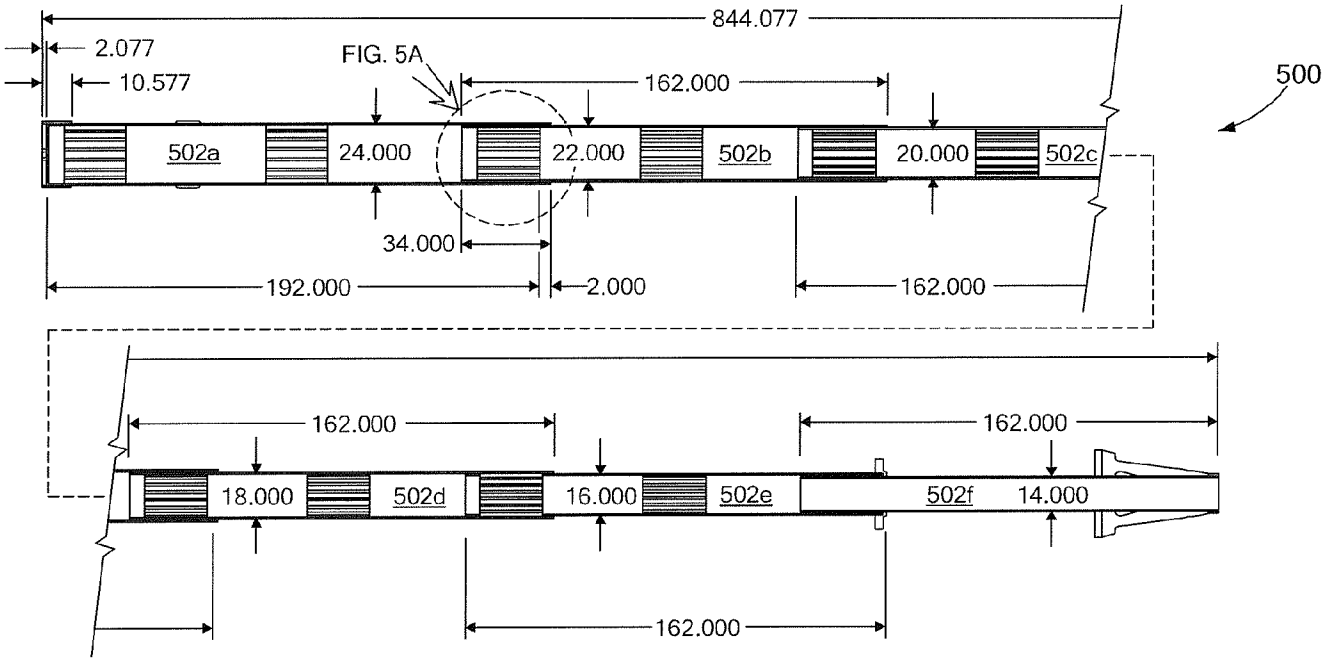
FIG. 5 is a side view of a mast system with the mast in an extended configuration in accordance with exemplary embodiments of the invention.
Figure 5A:
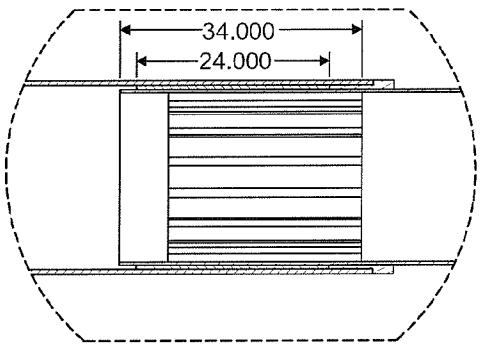
FIG. 5A is a side view of a portion of the mast system of FIG. 5.

In an alternative embodiment shown in FIGS. 4G-H, a cap 410 can include a respective pulley 420*a-d* for each guy wire 404'*a-d* for enabling the guy wires to telescope and retract the mast sections 402'. The cap 410 on the penultimate mast section 402*c* provides a focus point for the guy wires 404. In the illustrated embodiment, each of the four guy wires 404*a-d* passes through the cap 410 coupling with an engagement mechanism 406' for the respective mast section 402. It is understood that the mast cap 410 can be of any suitable geometry to provide a desired path for any number of guy wires. It is further understood that caps can be disposed on any of the mast sections.

FIGS. 5 and 5A-C shows an exemplary telescoping mast system 500 in accordance with exemplary embodiments of the invention having six mast sections 502*a-f*. Exemplary dimensions are shown for the mast sections in FIGS. 5A-5E. It is understood that any number of practical mast sections of any suitable geometry can be used to meet the needs of a particular application.

While exemplary embodiments of the invention are primarily shown and described as telescoping masts for antennas, it is understood that the inventive telescoping mast is applicable to any mast application for which it is desirable to elevate a load.

In another aspect of the invention, a telescoping mast includes an interface assembly for mast sections that includes a linear movement mechanism. In an exemplary embodiment, the movement mechanism includes a linear bushing 751. This arrangement enhances the strength of the mast and increases the ability of the mast to withstand harsh environments, such as wind driven sand.

Figure 6B:
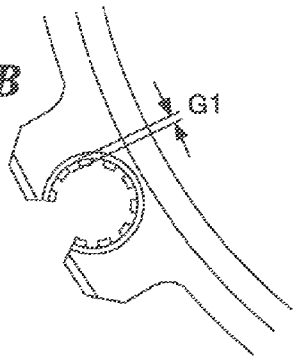
FIGS. 6A and 6B are top views showing additional detail for the mast assembly of FIG. 6
Figure 6A:
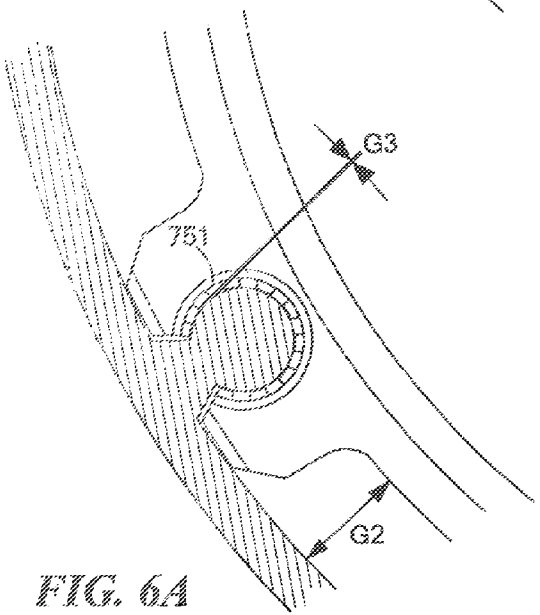
Figure 6:
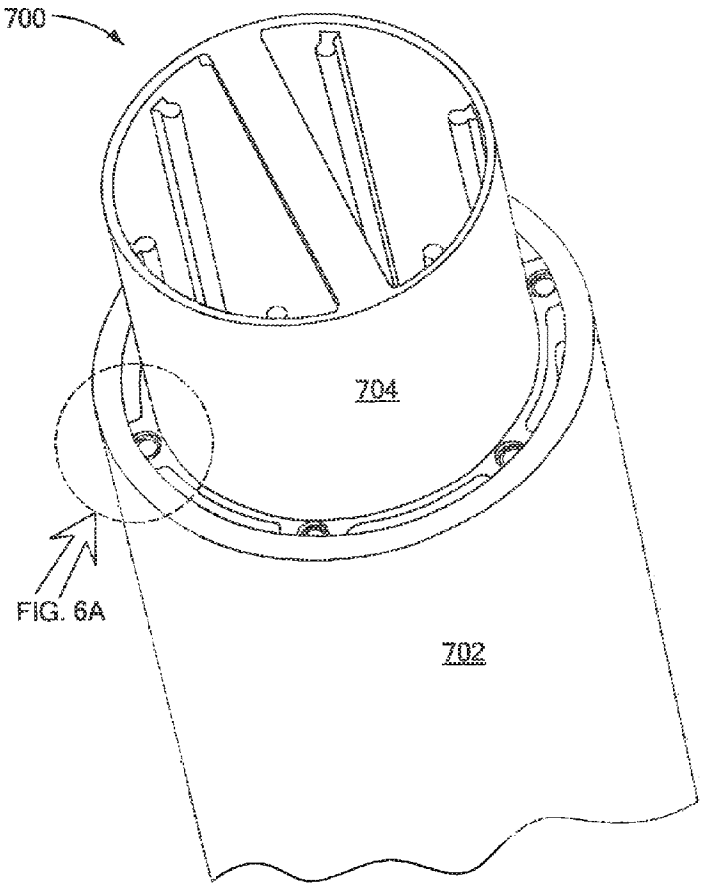
FIG. 6 is a schematic representation of a mast assembly in accordance with exemplary embodiments of the invention.

FIG. 6 shows an exemplary mast section assembly 700 including first and second telescoping mast sections 702, 704, each having similar structures of differing size since the second mast section 702 is captured in the first mast section 704.

Figure 7A:
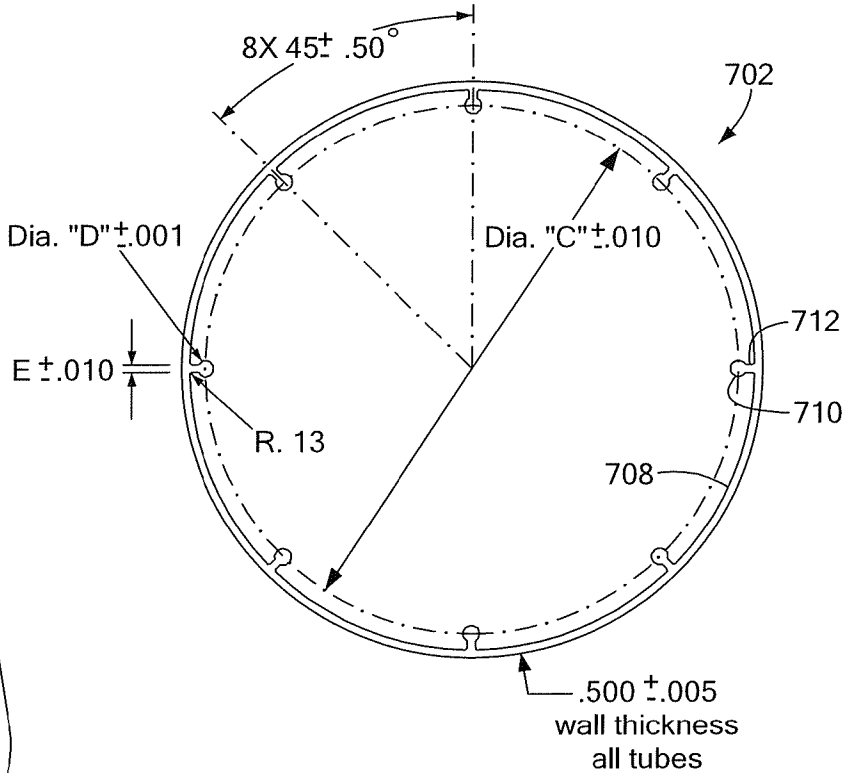
FIG. 7A is a top view of the first mast section of FIG. 7.
Figure 7:
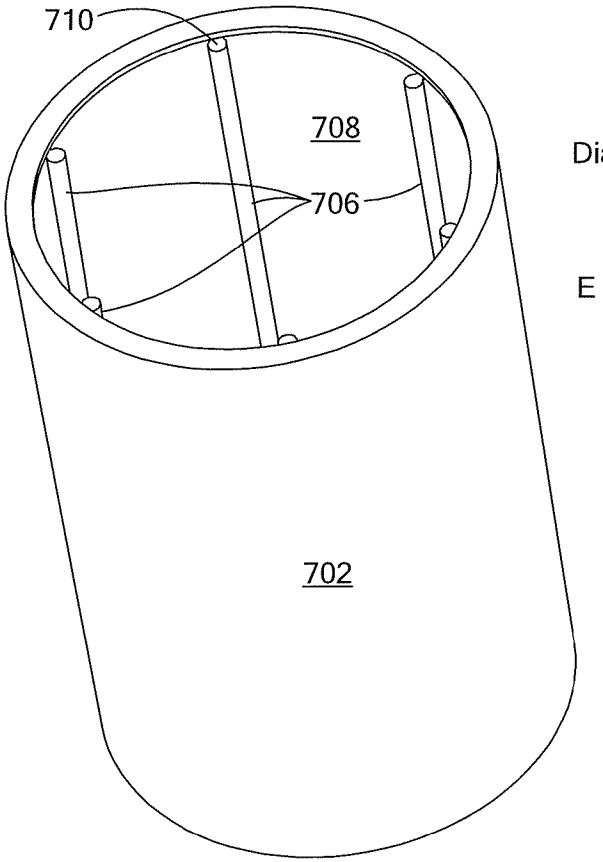
FIG. 7 is a schematic representation of a portion of a first mast section in accordance with exemplary embodiments of the invention.

As shown in FIG. 7, a first mast section 702 includes a series of longitudinal ribs 706 that extend along at least a portion of an inner surface 708 of the mast section. As shown more clearly in FIG. 7A, the ribs 706 include a bulbous portion 710 extending from a stem 712 terminating at the inner surface 708.

Figure 8A:
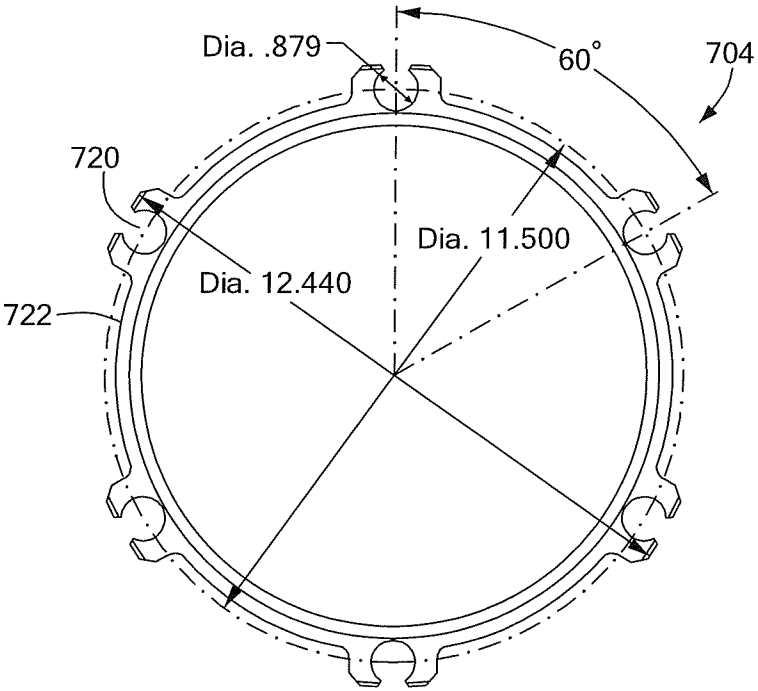
FIG. 8A is a top view of the second mast section of FIG. 8.
Figure 8:
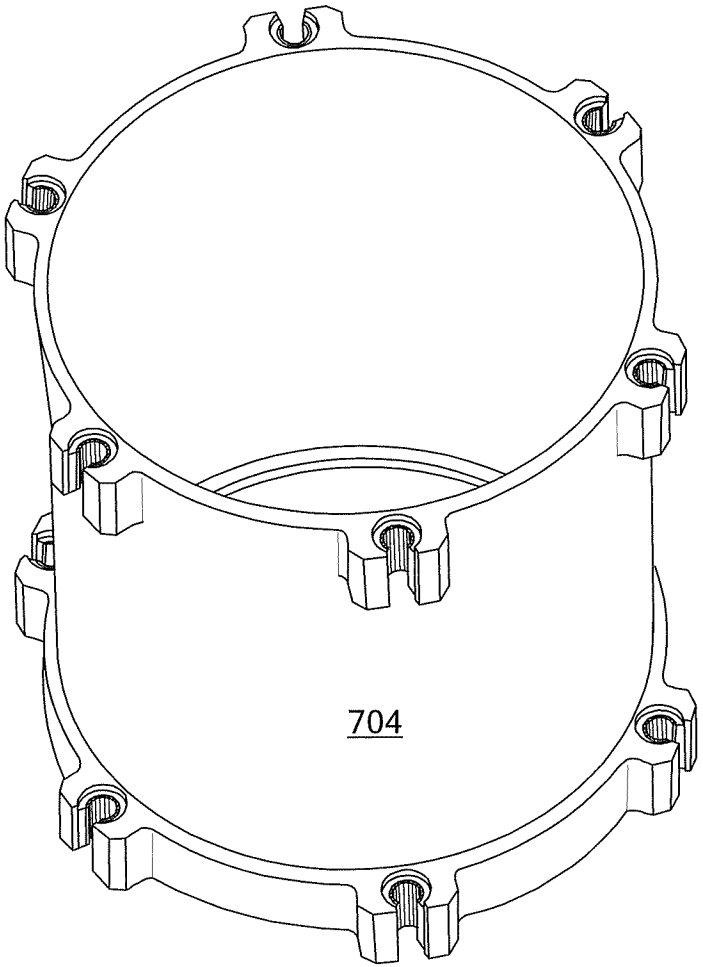
FIG. 8 is a schematic representation of a portion of a second mast section in accordance with exemplary embodiments of the invention.
Figure 8B:
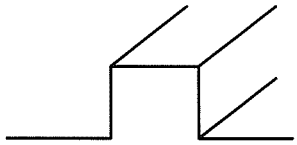
FIGS. 8B-8K are schematic representations of alternative rib embodiments for the mast assembly of FIG. 6.
Figure 8C:
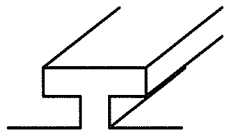
Figure 8D:
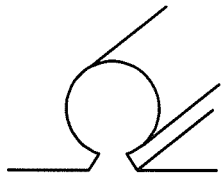
Figure 8E:
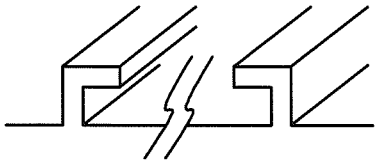
Figure 8F:
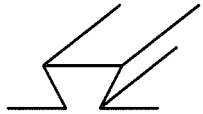
Figure 8G:
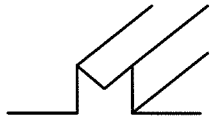
Figure 8H:
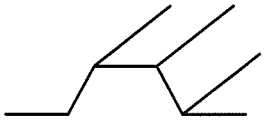
Figure 8I:
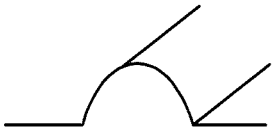
Figure 8J:
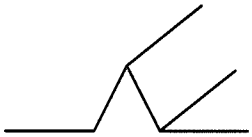
Figure 8K:
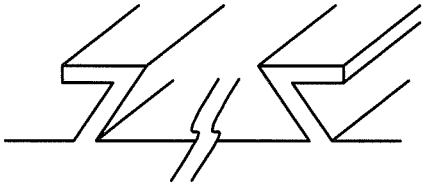

As shown in FIG. 8, the second mast section 704 includes a series of channels 720 extending along an outer surface 722 in alignment with the ribs 706 on the first mast section. The channels 720 are configured to capture the bulbous portion 710 of the ribs while allowing axial movement of the first and section mast sections.

In one embodiment, the channel 720 is circular extending more than 180 degrees so as to retain the bulbous portion 710 within the channel. The open portion of the channel 720 allows the stem 712 to travel in a path aligned with the channel while the bulbous portion 710 is retained in the channel 720.

The ribs 706 increase the strength and rigidity of the mast section 702 to enable heavier loads to be supported by the mast as compared to mast sections of similar thickness without ribs. The ribs 706 significantly increase the strength of the mast without requiring an increased thickness about the entire diameter of the section.

In an exemplary embodiment, the strength provided by the ribs 706 eliminates the need for outriggers and other stabilization structures. In other embodiments, stabilization structures can be included to further increase the load carrying capability and/or to enable mast installation in more severe environments, such as higher wind speeds.

In an exemplary embodiment, the rib 706/channel 702 structure provides a gap between the surfaces of the first and second mast sections 702, 704. This gap enables debris to easily pass through the mast sections. For example, in desert environments sand can pass through the gap between the first and second mast sections (and other mast section interfaces) without degrading the telescoping performance of the mast.

Figure 10B:
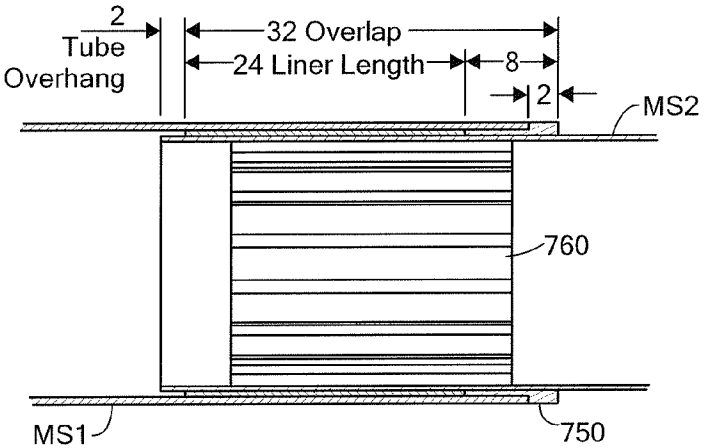
FIGS. 10, 10A, and 10B show exemplary dimensions for mast sections for a mast system in accordance with exemplary embodiments of the invention.

In one particular application, with reference to FIGS. 6A and 6B, first and second gaps G1, G2 should be greater than a selected size to enable debris to pass. In one embodiment, the first and second gaps G1, G2 are at least 0.04 inch to enable sand to pass through the mast without obstruction. Gaps G1, G2 less than this dimension will degrade performance of the mast due to debris build up. The guide rail to linear bearing interface gap G3 should be as close to zero as assembly tolerance allows. It is understood that for the second gap G2, as shown in FIGS. 10-10B, a liner 760 can have an undulating surface to form longitudinal gaps between the liner depressions and a surface of the respective mast section for debris passage.

Figure 9:
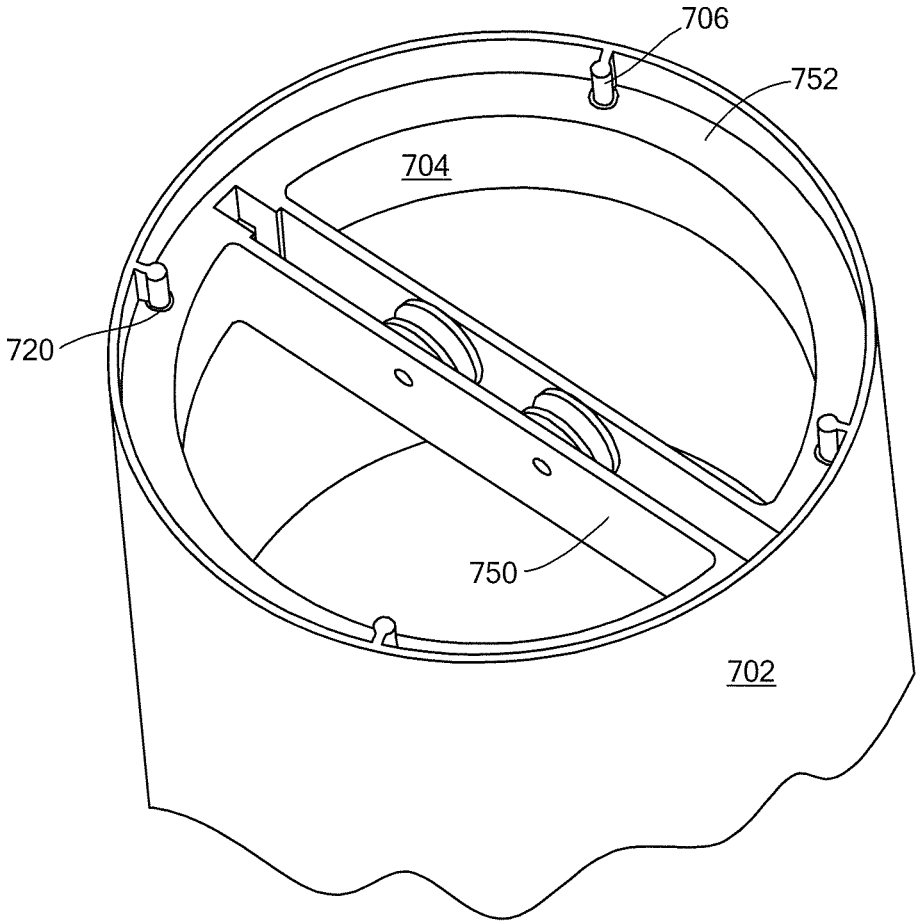
FIG. 9 is a schematic representation of a mast section interface configuration in accordance with exemplary embodiments of the invention.

FIG. 9 shows first and second mast sections 702, 704 with the ribs 706 of the first mast section 702 engaged with the channels 720 of the second mast section 704. The second mast section 704 includes an engagement mechanism 750, which can be similar to the engagement mechanism of FIG. 310 of FIG. 3, extending across the mast section. In general, the engagement mechanism 750 is secured to the mast section so as to enable a guy wire to manipulate the mast section, as described above in detail.

It is understood that mast sections can include ribs 706 on an inner surface and channels 720 on outer surface to enable movement of the respective mast sections.

In the illustrated embodiment, the engagement mechanism 750 forms a part of an end cap 752 extending about the inner surface of an end of the mast section. Apertures/channels 720 in the end cap 752 are provided for the ribs 706.

Figure 10A:
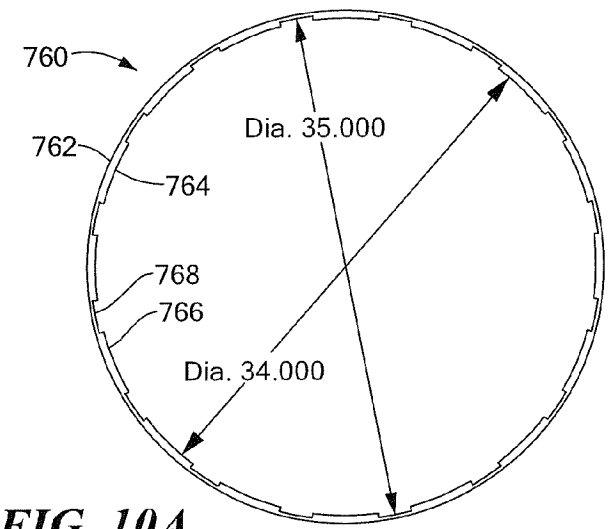
Figure 10C:
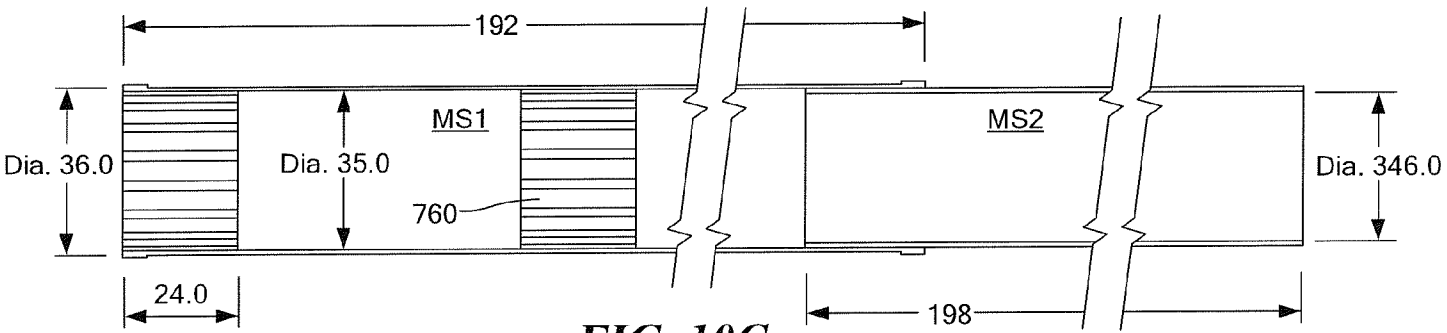

As shown in FIGS. 10, 10A, and 10B, which show exemplary dimensions, the mast section can further include a liner 760 to maintain alignment of the mast section and an enhanced mast section-to-section interface. An end cap 750 is disposed on an end of a first (larger) mast section MS1, which captures a second (smaller) mast section MS2. The liner 760 increases torsional stiffness and provides a bearing surface.

In an exemplary embodiment, the liner includes an outer surface 762 to complement an inner surface of a mast section and an undulating inner surface 764. The liner inner surface 764 includes thicker portions 766 and thinner portions 768. This arrangement maintains mast rigidity while providing pathways for debris to pass through the mast sections. The size and shape of the debris pathway is determined by the application design requirements.

It is understood that the liner inner surface 764 can have a wide range of geometries to provide a desired amount of contact between the liner and the mast section and shape and volume for the debris pathways. In an exemplary embodiment the mast section ribs 706 are circular in profile allowing for integration of circular (custom, modified, or commercial) linear guides. Other rib cross sectional profiles could be square, T-shaped, or other. The quantity of ribs is determined by the application design requirements. Illustrative alternative rib embodiments are shown in FIGS. 8B-8K.

The liner 760 can be fabricated from suitable high strength materials, including self-lubricating polymers suitable in environmental conditions, such as sand, dust, salt-spray, and extreme temperatures. The liner can be fabricated using pultrusion, extrusion, injection molded, machined, or other fabrication technique.

Having described exemplary embodiments of the invention, it will now become apparent to one of ordinary skill in the art that other embodiments incorporating their concepts may also be used. The embodiments contained herein should not be limited to disclosed embodiments but rather should be limited only by the spirit and scope of the appended claims. All publications and references cited herein are expressly incorporated herein by reference in their entirety.

What is claimed is:

1. A mast system, comprising:

a telescoping mast having coaxial first and second mast sections, the mast having a stowed configuration and a deployed configuration;

the first mast section including an inner surface having load-bearing ribs disposed thereon, wherein the ribs include a bulbous portion extending from a stem extending from an inner surface of the first mast section, and the second mast section including a coupling mechanism to engage the ribs on the first mast section for enabling only axial movement of the second mast section with respect to the first mast section, wherein the coupling mechanism includes channels having respective bushings to capture the ribs, the bushings having an undulating surface with alternating raised and non-raised sections forming longitudinal first gaps defined by a height of the raised sections and a height of the non-raised sections to allow debris passage, wherein a second gap is defined by opposing surfaces of the first and second mast sections to allow debris passage, and wherein a third gap is defined by raised sections of the bushing and interfacing surfaces of the ribs.

2. The mast system according to claim 1, further including a liner disposed in the second mast section.

3. The mast system according to claim 1, wherein the second gap is sized to allow debris to pass through the first and second mast sections.

4. The mast system according to claim 1, wherein the second gap is at least 0.04 inch.

5. The mast system according to claim 1, wherein the second mast section includes an engagement mechanism to engage a guy wire to stabilize the mast in a deployed configuration and to manipulate the second mast section to the deployed configuration.

6. The mast system according to claim 5, wherein the engagement mechanism forms part of an end cap extending about an inner surface of an end of the second mast section.

7. The mast system according to claim 6, wherein the end cap includes apertures for the ribs.

8. The mast system according to claim 1, wherein the ribs extend along substantially an entire length of the first mast section.

9. A method, comprising:

forming a telescoping mast having first and second mast sections, the mast having a stowed configuration and a deployed configuration;

employing load-bearing ribs on an inner surface of the first mast section to engage a coupling mechanism on the second mast section, wherein the ribs include a bulbous portion extending from a stem extending from an inner surface of the first mast section; and configuring the ribs and the coupling mechanism to enable axial movement of the second mast section with respect to the first mast section;

wherein the coupling mechanism includes channels having respective bushings to capture the ribs, the bushings having an undulating surface with alternating raised and non-raised sections forming longitudinal first gaps defined by a height of the raised sections and a height of the non-raised sections to allow debris passage, wherein a second gap is defined by opposing surfaces of the first and second mast sections to allow debris passage, and wherein a third gap is defined by raised sections of the bushing and interfacing surfaces of the ribs.

10. The method according to claim 9, wherein the second gap is at least 0.04 inch.

11. The method according to claim 9, further including employing an engagement mechanism to engage a guy wire to stabilize the mast in a deployed configuration and to manipulate the second mast section to the deployed configuration.

12. The method according to claim 9, wherein the ribs extend along substantially an entire length of the first mast section.

* * * * *